US009259922B2

(12) United States Patent
Cagle et al.

(10) Patent No.: US 9,259,922 B2
(45) Date of Patent: Feb. 16, 2016

(54) THERMAL INK JET PRINTING

(71) Applicant: HEWLETT-PACKARD DEVELOPMENT COMPANY, L.P., Houston, TX (US)

(72) Inventors: Phillip C. Cagle, San Marcos, CA (US); Paul Joseph Bruinsma, San Diego, CA (US); Satya Prakash, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 137 days.

(21) Appl. No.: 13/754,260

(22) Filed: Jan. 30, 2013

(65) Prior Publication Data

US 2014/0210912 A1 Jul. 31, 2014

(51) Int. Cl.

| | |
|---|---|
| ***B41J 29/38*** | (2006.01) |
| ***B41J 2/045*** | (2006.01) |
| ***B41J 2/14*** | (2006.01) |

(52) U.S. Cl.

CPC ..... *B41J 2/0458* (2013.01); *B41J 2/04588* (2013.01); *B41J 2/04598* (2013.01); *B41J 2/14129* (2013.01)

(58) Field of Classification Search

CPC ..... B41J 2/04581; B41J 2/04588; B41J 2/04593; B41J 2/04596

USPC ..... 347/9–11, 47

See application file for complete search history.

(56) References Cited

U.S. PATENT DOCUMENTS

| | | | | |
|---|---|---|---|---|
| 5,107,276 | A | 4/1992 | Kneezel et al. | |
| 8,303,084 | B2 | 11/2012 | Park et al. | |
| 2006/0181557 | A1 * | 8/2006 | Hoisington et al. | 347/11 |
| 2012/0019597 | A1 | 1/2012 | Chen et al. | |
| 2012/0293587 | A1 | 11/2012 | Bakker et al. | |

OTHER PUBLICATIONS

Keller, Stephan, et al., "Optimized plasma-deposited fluorocarbon coating for dry release and passivation of thin SU-8 cantilevers", MIC, Department of Micro and Nanotechnology, on pp. 1903-1908, vol. 25 Issue:6, Nov. 20, 2007.< http://ieeexplore.ieee.org/stamp/stamp.jsp?arnumber=4975684 >.

* cited by examiner

*Primary Examiner* — Lamson Nguyen

(74) *Attorney, Agent, or Firm* — Mannava & Kang, P.C.

(57) ABSTRACT

According to an example, a method for TIJ printing may include applying, by a processor, F electrical firing pulses to a resistor of a TIJ printhead for a duration of about 0.50 to 1.00 μs to jet a latex ink or a dispersed polymer particle ink from a nozzle. According to another example, a TIJ printing apparatus may include a TIJ printhead including a firing chamber to jet a latex ink or a dispersed polymer particle ink from a nozzle, and a resistor to heat the latex ink or the dispersed polymer particle ink to jet from the nozzle. The TIJ printing apparatus may further include a memory storing machine readable instructions to apply F electrical firing pulses to the resistor for a duration of about 0.50 to 1.00 μs to jet the latex ink or the dispersed polymer particle ink, and a processor to implement the machine readable instructions.

15 Claims, 9 Drawing Sheets

700

| Parameter | Overall range | Overall range | Range | Range |
|---|---|---|---|---|
| | *low* | *high* | *low* | *high* |
| A) Drop Weight | 2 | 50 | 6 | 12 |
| B) Resistor Length | | | | |
| 9 ng | 20 | 40 | 20 | 30 |
| 12 ng | 20 | 40 | 20 | 30 |
| C) Resistor Width | | | | |
| 9 ng | 8 | 20 | 15 | 20 |
| 12 ng | 12 | 24 | 19 | 24 |
| D) Thin film stack | | | | |
| TaxOy | 0 | 5100 | 2000 | 3500 |
| SIN/SiC Passivation | 900 | 2500 | 1000 | 1300 |
| E) SU8 thickness | | | | |
| chamber | 9 | 40 | 11 | 14 |
| tophat | 5 | 40 | 9 | 14 |
| F) Shelf Length | 15 | 60 | 17 | 25 |
| G) Pulse Parameter | | | | |
| P | 0.10 | 0.33 | 0.20 | 0.30 |
| D | 0.06 | 0.66 | 0.30 | 0.60 |
| F | 0.50 | 1.0 | 0.60 | 0.90 |
| H) Voltage | 23 | 35 | 25 | 29 |
| I) Warming Temp | 25 | 65 | 45 | 55 |
| J) Resistance | | | | |
| 9 ng | 550 | 1000 | 600 | 750 |
| 12 ng | 550 | 1000 | 550 | 700 |

Fig. 7

THERMAL INK JET PRINTING

BACKGROUND

Inkjet printing propels droplets of ink onto media to create a digital image. Thermal ink jet (TIJ) printing uses print cartridges that contain a series of firing chambers, each containing a resistive heater in a flow channel filled with ink. The firing chambers are often constructed by photolithography. In order to eject a droplet from each firing chamber, a pulse of current is passed through the heating element, causing rapid vaporization of a thin film immediately above the resistor to form a bubble. The rapid expansion of the bubble propels the remaining ink in the chamber through an orifice, ejecting a droplet of ink onto the media. Collapse of the vapor bubble pulls ink back into the firing chamber through a narrow channel attached to an ink reservoir, refilling the firing chamber for another droplet ejection.

BRIEF DESCRIPTION OF DRAWINGS

Features of the present disclosure are illustrated by way of example and not limited in the following figure(s), in which like numerals indicate like elements, in which:

FIG. 7 illustrates a table including relevant parameters for the TIJ printhead, according to an example of the present disclosure;

DETAILED DESCRIPTION

Figure 1:
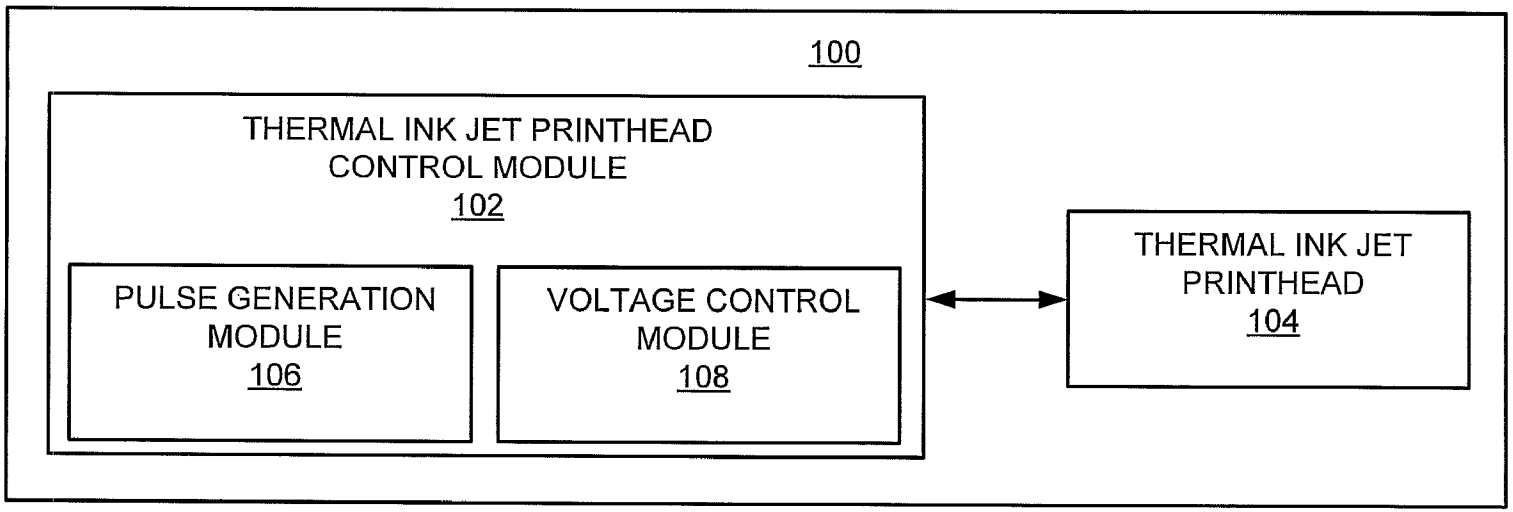
FIG. 1 illustrates an architecture of a thermal ink jet (TIJ) printing apparatus, according to an example of the present disclosure.

For simplicity and illustrative purposes, the present disclosure is described by referring mainly to examples. In the following description, numerous specific details are set forth in order to provide a thorough understanding of the present disclosure. It will be readily apparent however, that the present disclosure may be practiced without limitation to these specific details. In other instances, some methods and structures have not been described in detail so as not to unnecessarily obscure the present disclosure.

Throughout the present disclosure, the terms "a" and "an" are intended to denote at least one of a particular element. As used herein, the term "includes" means includes but not limited to, the term "including" means including but not limited to. The term "based on" means based at least in part on.

The durability of thermal inkjet inks has historically been limited by printhead reliability issues related to fouling of the inkjet resistor with ink components during the firing event, leading to erratic droplet ejection and overheating of the printhead, for example, at higher firing frequencies. For example, inks containing polymer dispersions can cause resistor and orifice fouling in a TIJ printhead. Polymer dispersions such as acrylic latices or polyurethane dispersions (PUD) can be used as binders to increase adhesion and rub resistance, but the same chemical properties that provide enhanced durability on the printed media also lead to enhanced rates of resistor fouling during TIJ printing. Reliability aspects of inks including dispersed polymers may be minimized or eliminated by a TIJ printing apparatus and a method for TIJ printing as disclosed herein. The apparatus and method disclosed herein provide thermally efficient printing with less resistor and orifice fouling.

Polymer dispersions with low particle size and low glass transition temperatures are often desirable as components for inkjet inks, but may be unreliable to jet due to film formation in the firing chamber. For example, polymer dispersions with particle sizes below 150 nm and glass transition temperatures below 80° C. may form resistor deposits more quickly than other dispersions during initial firing events (e.g., the first 300 to 1000 firing events). The resistor deposits may act as thermal insulators between a Tantalum (Ta) resistor surface and the ink. Thus the heat transfer to the ink may be reduced and the vapor drive bubble size may be attenuated. The polymer deposits on the resistor may be dynamic in nature. For example, during a train of firing events (e.g., firing at 2 kHz for several seconds), polymer may build up and flake off throughout the course of multiple firing events, dynamically changing the thickness of the residue on the resistor. These aspects may lead to variable vapor drive bubble size and erratic drop velocity and drop weight.

During a train of firing events under low heat flux conditions, portions of the polymer resistor deposit area may peel off in flakes. New resistor deposits may form over any freshly exposed resistor surface. Heat transfer may fluctuate with the polymer resistor deposits, which can lead to fluctuating drop velocity and drop weight, resulting in poor print quality of digital prints.

Under a high heat flux condition, the resistor deposits may be thinner and fluctuate less, and thus the vapor drive bubbles may be stronger and less erratic. For a given ink including a polymer dispersion, better print quality may be achieved under a high heat flux condition due to increased drop ejection quality.

In certain cases, fouling of the resistor by dispersed polymer residues may be minimized by operating the resistor at high surface temperature created by firing the resistor at high energies. However, these firing conditions can overheat the printhead, leading to thermal shutdown. In thermal shut down, enough heat is added that either multiple boiling events occur for each firing or the printhead is hot enough that the ink outgases air and blocks ink channels.

The high printhead temperatures may increase the rate of ink evaporation in the nozzle and on the topplate of the printhead, leading to buildup of solid residues near the nozzle. Alternatively, the resistor deposits coming off the resistor surface may be ejected with the ink onto the topplate, which can lead to the buildup of solid residues near the nozzles.

These solid residues near the nozzle may block or misdirect droplet ejection. The apparatus and method disclosed herein thus include thinner resistor thin film stacks to provide higher heating and cooling rates of the firing resistor with greater power efficiency, short pulse width firing pulses to limit time at temperature, and narrower chamber dimensions to provide enhanced fluidic ink refill speed between ejection cycles and more efficient ejection with the weaker drive bubble created by the thinner resistor thin film stacks and the short pulse width firing pulses, while minimizing cavitation damage to the resistor from collapse of the drive bubble. These factors provide improved reliability jetting of TIJ inks containing dispersed polymer particles, and further provide lower overall printhead temperatures over time.

According to an example, a TIJ printing apparatus and a method for TIJ printing are disclosed herein. The TIJ printing apparatus disclosed herein may use a thin stack of SU8, which is an epoxy-based negative photoresist, to define a firing chamber and nozzle for a TIJ printhead. The TIJ printing apparatus may also include thin films composed of Tungsten Silicon Nitride (WSiN) resistor material, passivation Silicon Nitride (SiN), passivation Silicon Carbide (SiC), and Tantalum (Ta) cavitation resistance. The TIJ printing apparatus may also provide improved jetting of latex based inks or generally dispersed polymer particle inks based on higher peak resistor temperatures. Examples of latex based inks and generally inks with dispersed polymer particles may include inks with acrylic latex, inks with polyurethane dispersion (PUD), inks with low solubility solution resins, etc. The combination of thinner resistor film stacks and short pulse widths provides higher peak resistor temperatures for the removal of deposits and residue on the resistor surface, to thus prevent fouling of a resistor surface. The higher peak resistor temperatures may be achieved by adding more power to the resistor through a shorter pulse duration, and the thermal efficiency may be achieved based on reduced heat capacity and losses through the thin film stack.

According to an example, a method for TIJ printing may include applying, by a processor, F electrical firing pulses to a resistor of a TIJ printhead for a duration of about 0.50 to about 1.00 μs to jet a latex ink or a dispersed polymer particle ink from a nozzle. The F electrical firing pulse may represent a main firing pulse as discussed in further detail below. According to another example, a TIJ printing apparatus may include a TIJ printhead including a firing chamber to jet a latex ink or a dispersed polymer particle ink from a nozzle, and a resistor to heat the latex ink or the dispersed polymer particle ink to jet from the nozzle. The TIJ printing apparatus may further include a memory storing machine readable instructions to apply F electrical pulses to the resistor for a duration of about 0.50 to about 1.00 μs to jet the latex ink or the dispersed polymer particle ink from the nozzle, and a processor to implement the machine readable instructions.

Based on the use of a thin stack of SU8, short firing pulse width, the thin film configuration described herein, and a predetermined resistor shelf length, the TIJ printing apparatus and method disclosed herein provide for the jetting of latex content inks with good nozzle velocity stability, less blow back, and therefore faster refill. The TIJ printing apparatus and method disclosed herein also provide for higher thermal efficiency (e.g., lower energy and overall printhead steady state operating temperature), and thus higher print speeds. Based, for example, on the higher thermal efficiency, latex content inks and generally dispersed polymer particle inks may be used with significantly less resistor fouling and orifice crusting. The TIJ printing apparatus disclosed herein also provides for improved resistor life by reducing bubble collapse severity based on the use of the thinner SU8 to define a firing chamber and nozzle for the TIJ printhead. The TIJ printing apparatus and the method for TIJ printing disclosed herein also provide for less blow-back, improved ink refill based on the use of the thin stack of SU8 and short firing pulse width, and thus faster print speeds. The resistor used with the TIJ printhead may also be relatively smaller because of the use of thinner SU8, even for higher ink drop weight. The apparatus and method disclosed herein thus use a specific high flux (but low total heat) printhead architecture and firing parameters to provide improved ejection of aqueous inks containing dispersed polymer particles.

FIG. 1 illustrates an architecture of a TIJ printing apparatus 100, according to an example. Referring to FIG. 1, the apparatus 100 is depicted as including a TIJ printhead control module 102 to control a TIJ printhead 104 via a pulse generation module 106 that is to generate pulses including a predetermined pulse width. The TIJ printhead control module 102 may further include a voltage control module 108 to apply a predetermined voltage to the TIJ printhead 104. The TIJ printhead control module 102 may further control other functions of the TIJ printhead 104, such as, resistor warming temperature, etc.

The modules 102, 106, and 108, and other components of the apparatus 100 that perform various other functions in the apparatus 100, may include machine readable instructions stored on a non-transitory computer readable medium. In addition, or alternatively, the modules 102, 106, and 108, and other components of the apparatus 100 may include hardware or a combination of machine readable instructions and hardware.

Figure 2:
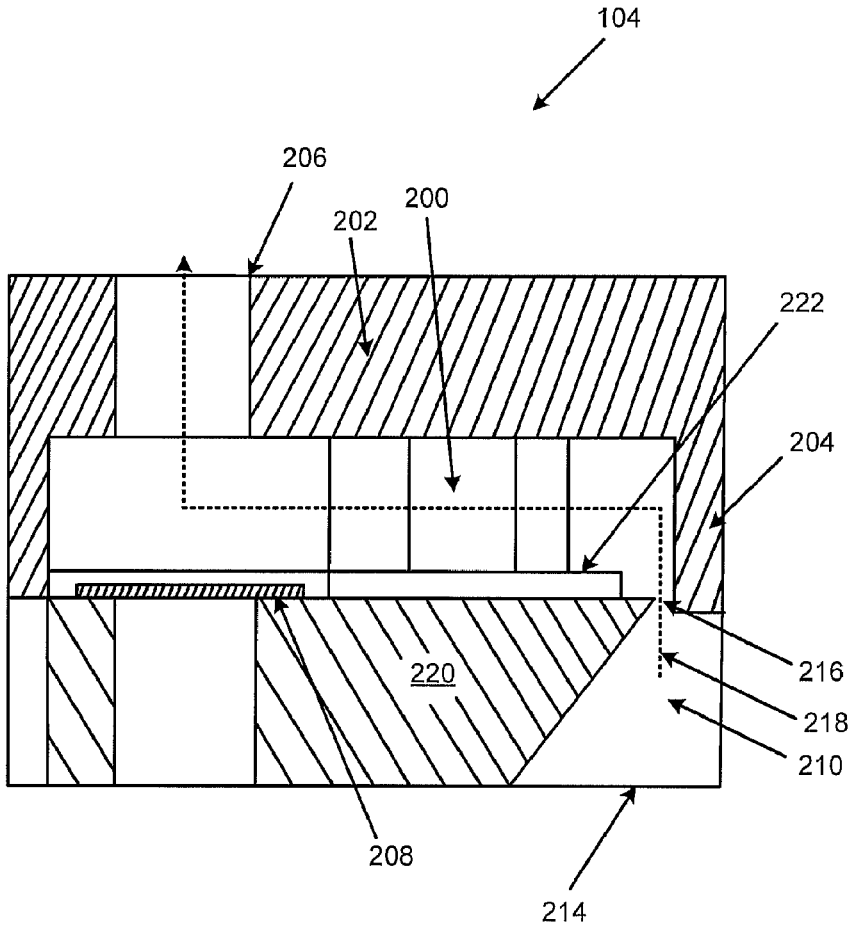
FIG. 2 illustrates a cross-sectional view of a TIJ printhead firing chamber, according to an example of the present disclosure.

Referring to FIGS. 1 and 2, FIG. 2 illustrates a cross-sectional view of a TIJ printhead firing chamber 200 for the TIJ printhead 104, according to an example of the present disclosure. The TIJ printhead firing chamber 200 may generally be defined by a SU8 bore layer 202 and a SU8 chamber layer 204. The SU8 bore layer 202 and the SU8 chamber layer 204 may respectively define the firing chamber 200 and a nozzle 206. The TIJ printhead firing chamber 200 may include a resistor 208 to heat latex ink 210 (or generally dispersed polymer particle ink) in the firing chamber 200 and eject ink drops from the nozzle 206. The latex ink 210 may flow from ink reservoir 214, via a trench 216 into the firing chamber 200, and is ejected through the nozzle 206, as represented by dotted line 218. The base of the firing chamber 200 and the resistor 208 may be supported by a substrate 220 formed, for example, of Silicon (Si). The base of the firing chamber 200 may also include a primer layer 222.

FIG. 7 illustrates a table 700 including relevant parameters for the TIJ printhead 104, according to an example of the present disclosure. Referring to FIGS. 2 and 7, the latex ink 210 drop weight may be in a range of about 6-12 ng, and include an overall range of about 2-50 ng. The nozzle diameter (i.e. bore diameter) may be based on the needed latex ink 210 drop weight, with some of the parameters as disclosed herein (e.g., resistor length, resistor width, nozzle diameter, and resistance) being described for about 9 ng and about 12 ng latex ink drop weights. The nozzle diameter dependent parameters may be scaled as needed with the needed latex ink 210 drop weight. Other parameters, such as, the SU8 bore layer 202 and the SU8 chamber layer 204, the thin film stack 300 described below with reference to FIG. 3, the shelf length of the resistor 208, pulse parameters described below with reference to FIG. 5, voltage, and warming temperature may be considered independent of the needed latex ink 210 drop weight. Since higher heat flux results in reduced penetration distance of heat into the latex ink 210, a smaller volume of the latex ink 210 is heated and reduces the heat needed to nucleate and produce a drive bubble. Therefore, the resistance of the resistor 208 may be lowered by increasing the thickness of the resistor 208 or by using a lower resistivity film material. Based on the aforementioned principles, the TIJ printhead 104 parameters disclosed herein with reference to FIG. 7 may be based on a resistor 208 heat flux in a range of about 0.5-4.0 $kJ/m^2$.

Referring to FIGS. 2 and 7, the shelf length of the resistor 208, which is measured from the edge of the trench 216 closer to the resistor 208 to the center-line of the nozzle 206 may be in a range of about 17-25 μm, and include an overall range of about 15-60 μm. The SU8 bore layer 202 may be formed in a range of about 9-14 μm, and include an overall range of about 5-40 μm. The SU8 chamber layer 204 may be formed in a range of about 11-14 μm, and include an overall range of about 9-40 μm. The aforementioned parameters of the firing chamber 200 provide more complete ejection of the contents of the firing chamber 200 due to lower inertial fluidic resistance created by narrowing the chamber wall thickness (i.e., thickness of the SU8 chamber layer 204), allowing more efficient printing with a smaller resistor 208. The aforementioned parameters of the firing chamber 200 also provide for faster refill of the firing chamber 200 based on the shortened length of the ink feed channel (i.e., the distance from the edge of the trench 216 closer to the resistor 208 to the center-line of the nozzle 206).

Figure 3:
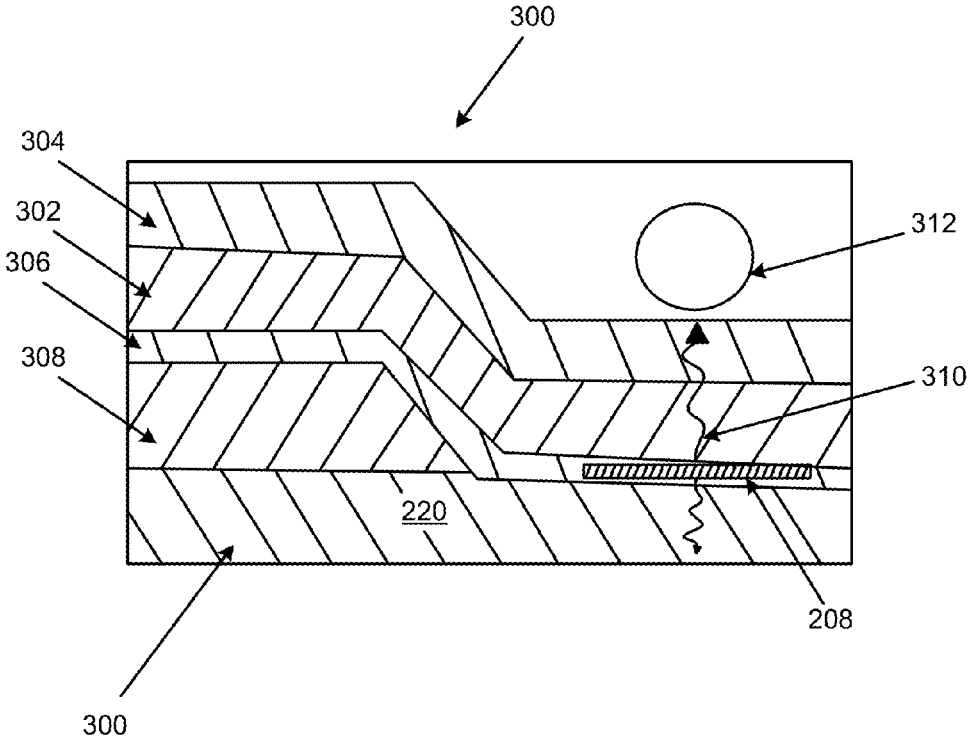
FIG. 3 illustrates a cross-sectional view of a TIJ printhead resistor and associated thin film stack, according to an example of the present disclosure.

Referring to FIGS. 1-3, FIG. 3 illustrates a cross-sectional view of the TIJ printhead resistor 208, according to an example of the present disclosure. The resistor 208 may include the thin film stack 300 including, for example, passivation SiN and SiC layers 302, and a Ta cavitation resistance layer 304. The passivation SiN/SiC layers 302 function as chemical and electrical barriers for the resistor 208. The passivation SiN/SiC layers 302 and the Ta cavitation resistance layer 304 may be provided, for example, on a WSiN resistor material layer 306, which is provided, for example, on an Aluminum (Al) substrate 308. Heat generated by the resistor 208 as indicated at 310 may cause an ink vapor bubble 312 to form and exit the nozzle 206.

Referring to FIGS. 1-3 and 7, the Ta cavitation resistance layer 304 may be formed in a range of about 2000-3500 Å, and include an overall range of about 0-5100 Å. The passivation SiN and SiC layers 302 may formed be in a range of about 1000-1300 Å, and include an overall range of about 900-2500 Å. The use of thinner thin stacks alone with thinner Ta can reduce the resistor life of the printhead 104. The collapsing vapor bubble results in cavitation pits that eventually erode through the Ta cavitation resistance layer 304 and the other barriers leading to resistor failure. However, by using a thinner nozzle layer (i.e., the SU8 bore layer 202) and chamber (i.e., the SU8 chamber layer 204), the strength of the drive bubble collapse may be reduced.

Referring to FIGS. 1-4, FIG. 4 illustrates various views of resistor crusting from latex material, according to an example of the present disclosure. The latex ink 210 may include suspended latex particles 400 that stick to a resistor surface 402 to form a residue 404. During continued use of the TIJ printhead 104, the crusting layer thickness increases as shown at 406.

Figure 8:
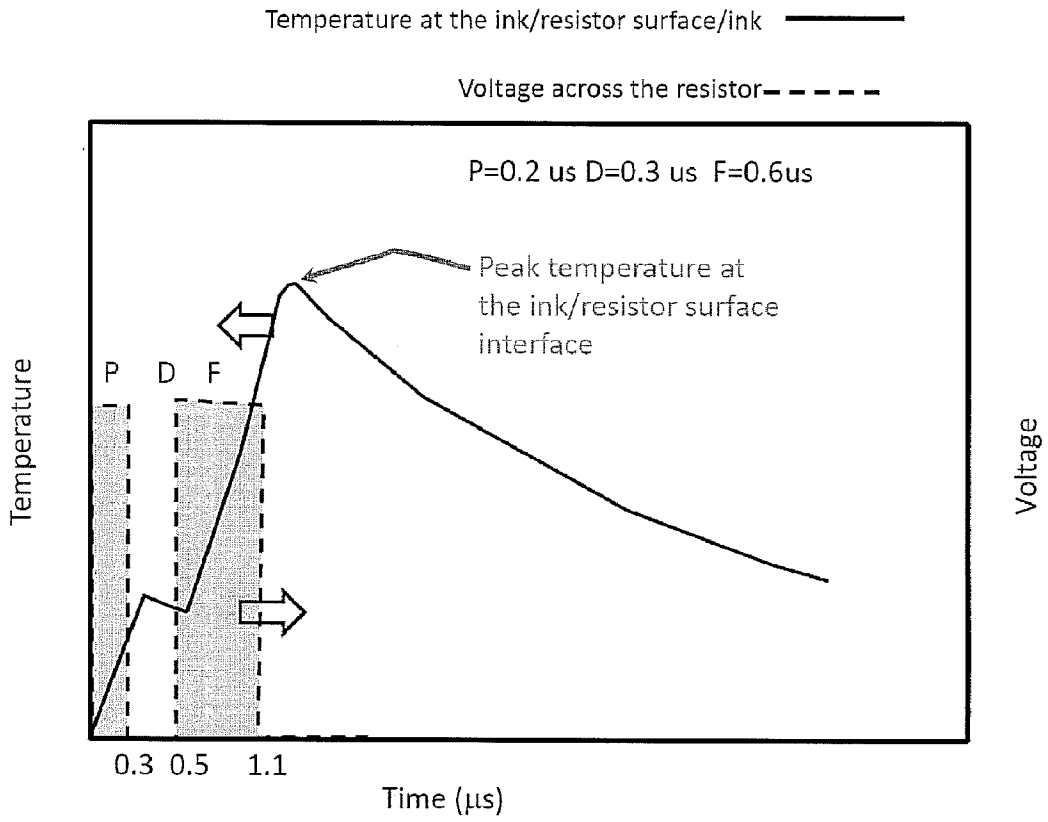
FIG. 8 illustrates a conceptual relationship between electrical pulses P and F to temperature at an ink/resistor surface interface, according to an example of the present disclosure.

Referring to FIGS. 1-5, FIG. 5 illustrates a pulse shape 500 applied to a TIJ printhead resistor, according to an example of the present disclosure. The pulse shape 500 may include pulse parameters P, D, and F, respectively at 502, 504, and 506, voltage at 508, and time at 510. For the pulse parameters P, D, and F, P may represent the precursor pulse duration, D may represent the dead time, and F may represent the firing pulse duration. FIG. 8 shows a conceptual relationship between the pulses P and F to temperature at an ink/resistor surface interface. The temperature scale may represent several hundreds of degrees C. Power may be applied during the pulse P, generating heat in the resistor material. Heat may conduct out of the resistor material, through the passivation SiN and SiC layers 302, and the Ta cavitation resistance layer 304. At the end of the pulse P, the electrical power may be briefly shut off (e.g., by closing of a transistor switch). Heat may continue to conduct after power is shut off so the a maximum temperature at the ink/resistor surface occurs during D. The interface temperature may briefly fall as heat conducts further into the ink, increasing the ink film thickness that has been preheated by the pulse P. During the pulse F, the electrical power may be turned on and after a brief time lag, the ink resistor surface temperature may rise again. During the pulse F, the vapor nucleates and a vapor bubble may be generated to drive the drop ejection.

At the end of the pulse F period, the power may be shut off. Heat may continue to conduct to the ink. After a brief time lag, a maximum temperature may be reached. Achieving a high temperature maximum may provide for the jetting of ink components such as latex binders that would otherwise foul the resistor surface.

A high maximum temperature may be achieved by increasing the duration of the pulse F well beyond what is needed to generate the vapor bubble (i.e., increasing overenergy). This leads to overheating of the printhead. Alternatively, a high maximum temperature may be achieved by shortening the pulse durations and increasing the electrical power.

Figure 5:
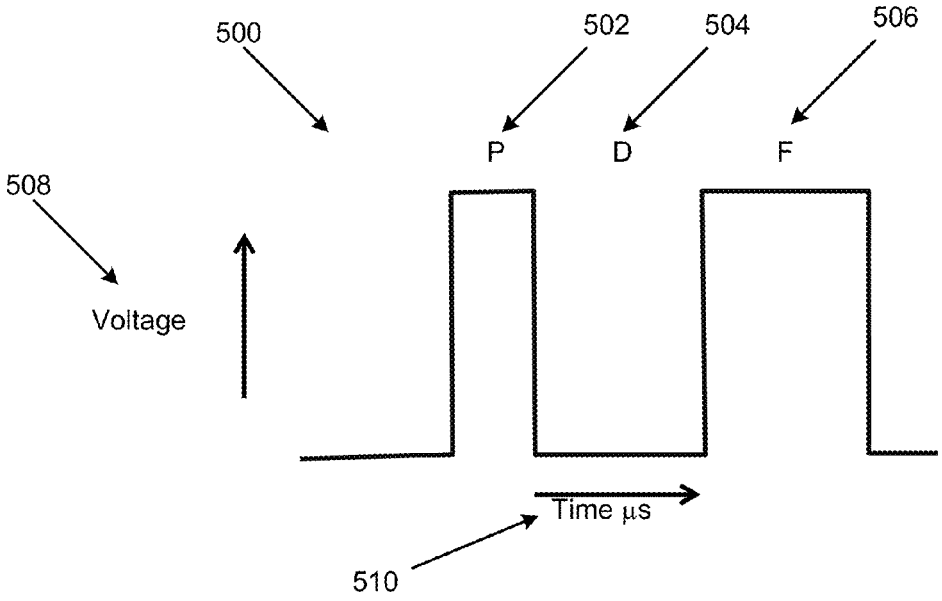
FIG. 5 illustrates a pulse shape applied to a TIJ printhead resistor, according to an example of the present disclosure.

Referring to FIGS. 5 and 8, as discussed above, for the pulse parameters P, D, and F, P may represent the precursor pulse duration, D may represent the dead time, and F may represent the firing pulse duration. The precursor pulse P conducts heat into the ink film immediately in contact with the resistor surface. The precursor dead time D is a short delay that allows the heat from the pulse P to conduct further into the ink film. The combination of P and D allows preheating of the ink film just prior to the main firing pulse of F. Elevating the ink film temperature may enhance the size of the vapor bubble, which increases drop weight and drop velocity. The pulse P should not be of such magnitude that the ink nucleates to form vapor bubbles prior to the pulse F. D should be sufficiently long to allow heat conduction into the ink. Generally, the pulse P may be one third of the pulse F, and D may be two thirds of the pulse F in terms of duration. For general electronics, the drive voltages of the pulses P and F may be the same so the heights of the pulses in FIG. 5 are equal. Beyond the two pulse scheme described herein with reference to FIG. 5, those skilled in the art would appreciate in view of this disclosure that a plurality of pulses may be employed to generate the vapor bubble that drives the drop ejection.

Referring to FIGS. 5 and 7, the pulse parameter P may include a duration of about 0.20-0.30 μs, and include an overall duration of about 0.10-0.33 μs. The pulse parameter D may include a duration of about 0.30-0.60 μs, and include an overall duration of about 0.06-0.66 μs. The pulse parameter F may include a duration of about 0.60-0.90 μs, and include an overall duration of about 0.50-1.00 μs. The pulse applied to the resistor 208 may be in a single pulse (i.e., D=0) or precursor pulse mode. The firing voltage may be in a range of about 25-29 V, and include an overall range of about 23-35 V. The total energy E applied to the resistor 208 may be calculated using the following Equation:

$$E = \frac{(P+F)V^2}{R} \quad \text{Equation (1)}$$

For Equation (1), E is the total heat energy, and V is the firing voltage and R is the resistance. For Equation (1), parasitic resistances may be ignored by defining V as the voltage reaching the firing resistor. It follows the energies for the P pulse and the F pulse may be defined as follows:

$$E_P = \frac{PV^2}{R} \quad \text{Equation (2)}$$

$$E_F = \frac{FV^2}{R} \quad \text{Equation (3)}$$

Figure 4:
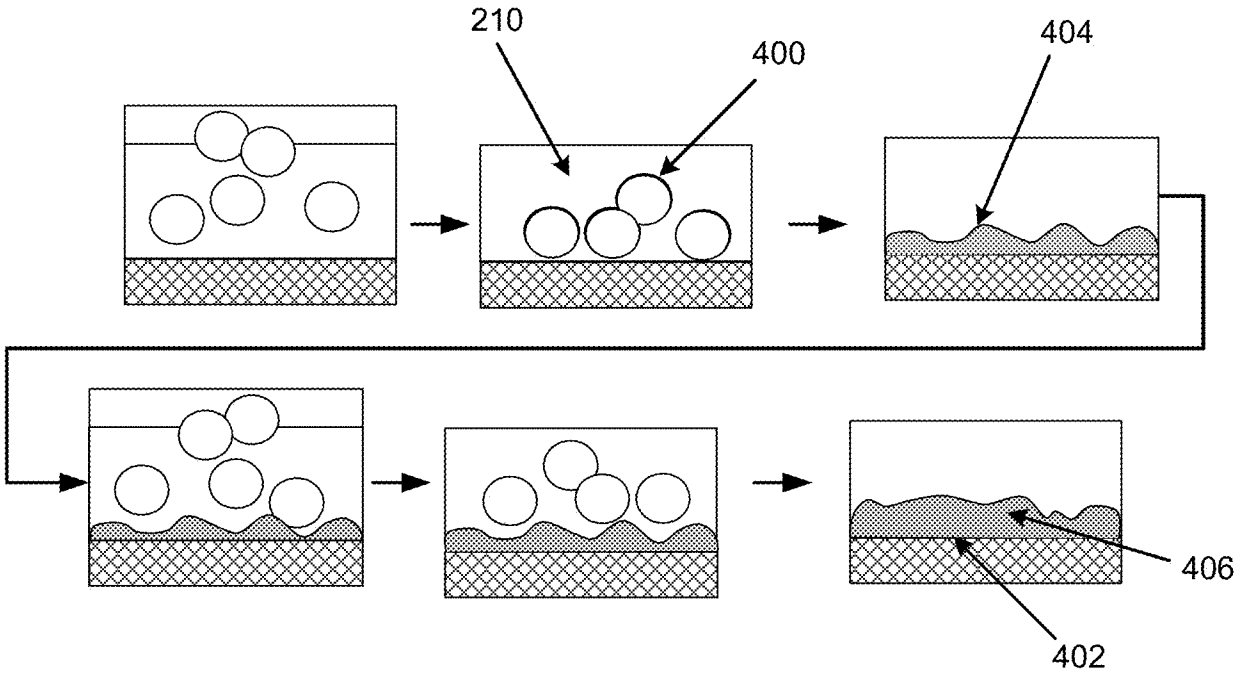
FIG. 4 illustrates various views of resistor crusting from latex material, according to an example of the present disclosure.

The short pulse width firing pulses limit heating of the TIJ printhead 104 and bulk latex ink 210, leading to lower temperatures of the TIJ printhead 104 and less destabilization of the latex ink 210 during a firing event, resulting in less fouling of the resistor 208 with polymer particle residue (thus eliminating the crusting 404 or 406 shown in FIG. 4). The pulse width parameters described herein and the thinner thin film stack of the passivation SiN/SiC layers 302, and the Ta cavitation resistance layer 304 also improve the temperature uniformity of the resistor surface, which increases the effective area fraction of the resistor surface that transfers heat to the latex ink 210.

Referring to FIGS. 1-6, FIG. 6 illustrates a top view of the TIJ printhead resistor 208 for determining the resistor parameters, according to an example of the present disclosure. The resistor 208 may include a resistor length 600, a conductor 602 including a conductor width 604, and a current flow direction 606. The total energy E for the resistor 208 may be calculated using the Equation (1). The resistance of the resistor 208 may be determined as follows:

$$R = \frac{R_{sheet} \times L}{W} \quad \text{Equation (4)}$$

Figure 6:
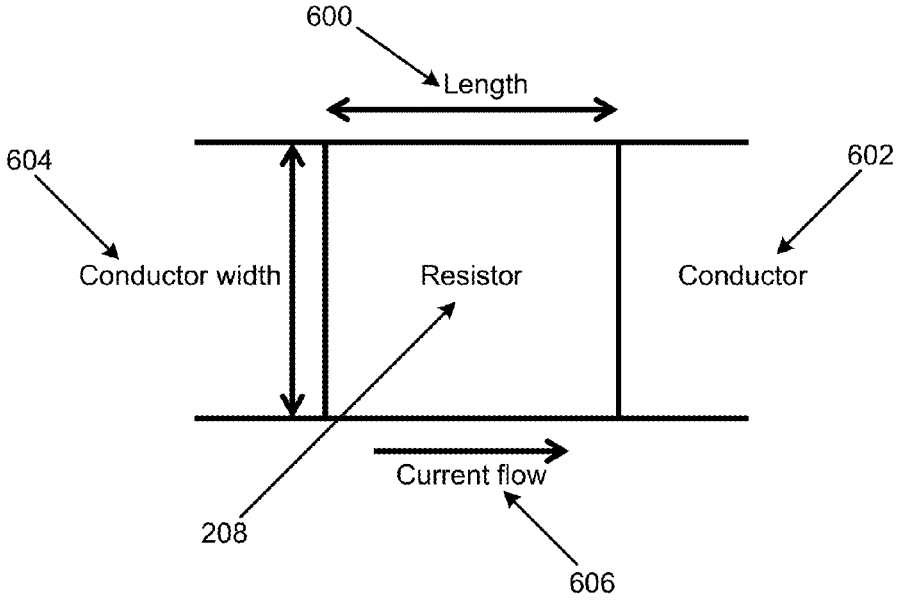
FIG. 6 illustrates a top view of the TIJ printhead resistor for determining the resistor parameters, according to an example of the present disclosure.

For Equation (4), L is the resistor length, W is the resistor width, and $R_{sheet}$ is the sheet resistance of the resistor 208 (i.e., the resistor thin film). Referring to FIGS. 6 and 7, the resistor length L may be in a range of about 20-30 μm, and include an overall range of about 20-40 μm for a 9 or 12 ng ink drop weight. The resistor width W may be in a range of about 15-20 μm, and include an overall range of about 8-20 μm for an example of a 9 ng ink drop weight. Further, the resistor width W may be in a range of about 19-24 μm, and include an overall range of about 12-24 μm for an example of a 12 ng ink drop weight. The resistor warming temperature may be in a range of about 45-55° C., and include an overall range of about 25-65° C. The resistance of the resistor 208 may be in a range of about 600-750Ω, and include an overall range of about 550-1000Ω for an example of a 9 ng ink drop weight. Further, the resistance of the resistor 208 may be in a range of about 550-700Ω, and include an overall range of about 550-1000Ω for an example of a 12 ng ink drop weight. The low aspect ratio of the resistor 208, and the aforementioned thinner film stack dimensions for the Ta cavitation resistance layer 304 and passivation SiN and SiC layers 302 provide for lower resistance and increased thermal efficiency. Based on the aforementioned parameters, the TIJ printhead 104 may include a firing frequency, for example, of up to about 48 kHz, depending on the drop weight and properties of the latex ink 210 (and generally a dispersed polymer particle ink).

Figure 9:
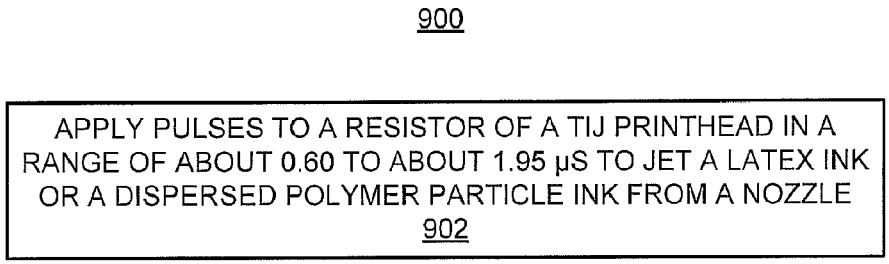
FIG. 9 illustrates a method for TIJ printing, according to an example of the present disclosure.
Figure 10:
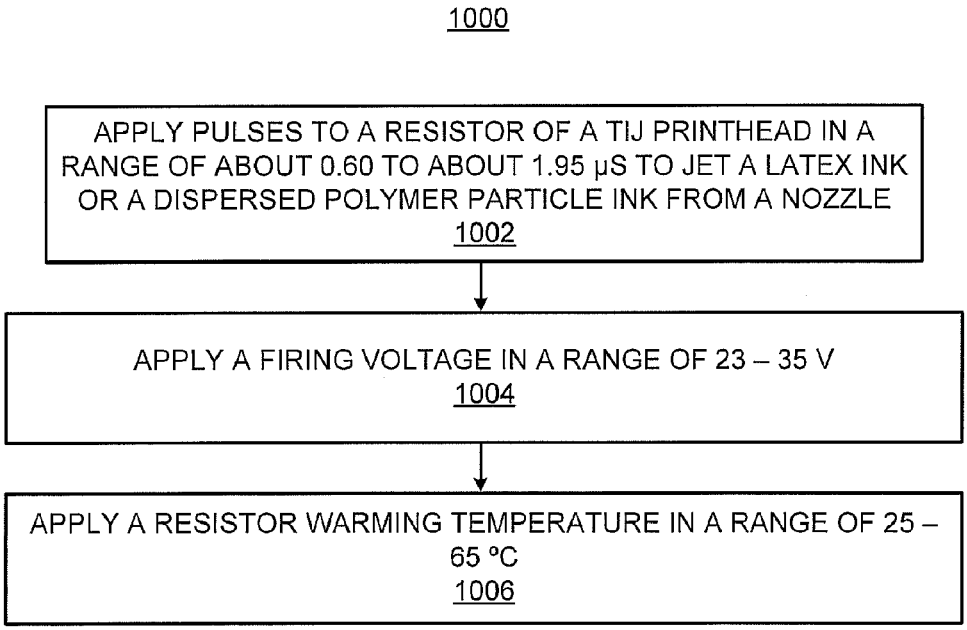
FIG. 10 illustrates further details of the method for TIJ printing, according to an example of the present disclosure.

FIGS. 9 and 10 respectively illustrate flowcharts of methods 900 and 1000 for TIJ printing, corresponding to the example of the TIJ printing apparatus 100 whose construction is described in detail above. The methods 900 and 1000 may be implemented on the TIJ printing apparatus 100 with reference to FIG. 1 by way of example and not limitation. The methods 900 and 1000 may be practiced in other apparatus.

Referring to FIG. 9, for the method 900, at block 902, F electrical firing pulses are applied to a resistor of a TIJ printhead for a duration of about 0.50 to 1.00 μs to jet a latex ink or a dispersed polymer particle ink from a nozzle. For example, referring to FIGS. 1 and 2, F electrical firing pulses are applied to the resistor 208 of the TIJ printhead 104 by the pulse generation module 106 for a duration of about 0.50 to 1.00 μs to jet a latex ink or a dispersed polymer particle ink from the nozzle 206. Applying the F electrical firing pulses to the resistor may further include applying the F electrical firing pulses for a duration of about 0.60 to about 0.90 μs.

Referring to FIG. 10, for the method 1000, at block 1002, F electrical firing pulses are applied to a resistor of a TIJ printhead for a duration of about 0.50 to 1.00 μs to jet a latex ink or a dispersed polymer particle ink from a nozzle. For example, referring to FIGS. 1 and 2, F electrical firing pulses are applied to the resistor 208 of the TIJ printhead 104 by the pulse generation module 106 for a duration of about 0.50 to about 1.00 μs to jet a latex ink or a dispersed polymer particle ink from the nozzle 206. The method 1000 may further include forming a thin film stack for the TIJ printhead to include a Ta cavitation resistance layer in a range of about 0-5100 Å, and passivation SiN and SiC layers in a range of about 900-2500 Å. Forming the thin film stack may further include forming the Ta cavitation resistance layer in a range of about 2000-3500 Å, and the passivation SiN and SiC layers in a range of about 1000-1300 Å. The method 1000 may further include forming a firing chamber by using a SU8 bore layer in a range of about 5-40 μm, and a SU8 chamber layer in a range of about 9-40 μm. Forming the firing chamber may further include forming the SU8 bore layer in a range of about 9-14 μm, and the SU8 chamber layer in a range of about 11-14 μm. The method 1000 may further include forming the resistor and a firing chamber of a shelf length in a range of about 15-60 μm. Forming the resistor and the firing chamber may further include forming the resistor and the firing chamber of the shelf length in a range of about 17-25 μm.

At block 1004, a firing voltage is applied in a range of about 23-35 V. For example, referring to FIGS. 1 and 2, a firing voltage is applied to the resistor 208 in a range of about 23-35 V by the voltage control module 108. Applying the firing voltage may further include applying the firing voltage in a range of about 25-29 V.

At block 1006, a resistor warming temperature is applied in a range of about 25-65° C. For example, referring to FIGS. 1 and 2, a resistor warming temperature is applied in a range of about 25-65° C. by the TIJ printhead control module 102. Applying the resistor warming temperature may further include applying the resistor warming temperature in a range of about 45-55° C.

Figure 11:
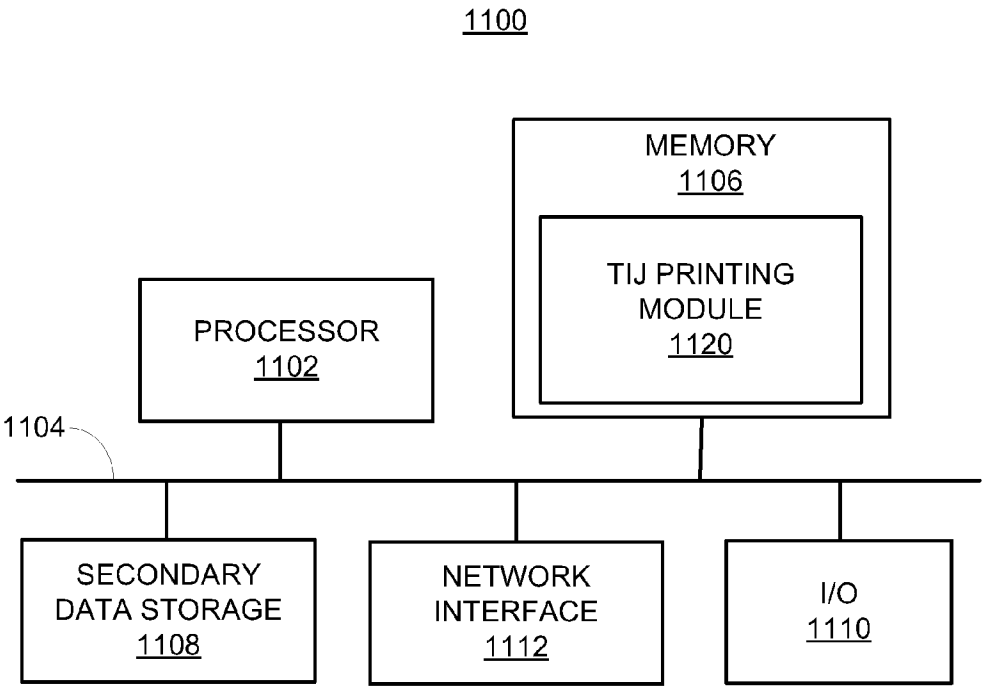
FIG. 11 illustrates a computer system, according to an example of the present disclosure.

FIG. 11 shows a computer system 1100 that may be used with the examples described herein. The computer system represents a generic platform that includes components that may be in a server or another computer system. The computer system 1100 may be used as a platform for the apparatus 100. The computer system 1100 may execute, by a processor or other hardware processing circuit, the methods, functions and other processes described herein. These methods, functions and other processes may be embodied as machine readable instructions stored on a computer readable medium, which may be non-transitory, such as hardware storage devices (e.g., RAM (random access memory), ROM (read only memory), EPROM (erasable, programmable ROM), EEPROM (electrically erasable, programmable ROM), hard drives, and flash memory).

The computer system 1100 includes a processor 1102 that may implement or execute machine readable instructions performing some or all of the methods, functions and other processes described herein. Commands and data from the processor 1102 are communicated over a communication bus 1104. The computer system also includes a main memory 1106, such as a random access memory (RAM), where the machine readable instructions and data for the processor 1102 may reside during runtime, and a secondary data storage 1108, which may be non-volatile and stores machine readable instructions and data. The memory and data storage are examples of computer readable mediums. The memory 1106 may include a TIJ printing module 1120 including machine readable instructions residing in the memory 1106 during runtime and executed by the processor 1102. The TIJ printing module 1120 may include the modules 102, 106, and 108 of the apparatus shown in FIG. 1.

What is claimed is:

1. A method for thermal ink jet (TIJ) printing, the method comprising:

applying, by a processor, F electrical firing pulses to a resistor of a TIJ printhead for a duration of about 0.50 to 1.00 μs to jet a latex ink or a dispersed polymer particle ink from a nozzle, wherein an F electrical firing pulse represents a main electrical firing pulse.

2. The method of claim 1, wherein applying the F electrical firing pulses to the resistor further comprises:

applying the F electrical firing pulses for a duration of about 0.60 to 0.90 μs.

3. The method of claim 1, further comprising:

utilizing a thin film stack for the TIJ printhead, wherein the thin film stack includes:

a Tantalum (Ta) cavitation resistance layer in a range of about 0-5100 Å, and passivation Silicon Nitride (SiN) and Silicon Carbide (SiC) layers in a range of about 900-2500 Å.

4. The method of claim 3, wherein utilizing the thin film stack further comprises utilizing:

the Ta cavitation resistance layer in a range of about 2000-3500 Å, and the passivation SiN and SiC layers in a range of about 1000-1300 Å.

5. The method of claim 1, further comprising utilizing a firing chamber for the TIJ printhead, wherein the firing chamber includes:

a SU8 bore layer in a range of about 5-40 μm, and a SU8 chamber layer in a range of about 9-40 μm.

6. The method of claim 5, wherein utilizing the firing chamber further comprises using:

the SU8 bore layer in a range of about 9-14 μm; and the SU8 chamber layer in a range of about 11-14 μm.

7. The method of claim 1, further comprising:

utilizing the resistor and a firing chamber for the TIJ printhead, wherein the resistor and the firing chamber include a shelf length in a range of about 15-60 μm.

8. The method of claim 7, wherein utilizing the resistor and the firing chamber further comprises:

utilizing the resistor and the firing chamber that include the shelf length in a range of about 17-25 μm.

9. The method of claim 1, further comprising:

applying a firing voltage in a range of about 23-35 V; and applying a resistor warming temperature in a range of about 25-65° C.

10. The method of claim 1, wherein applying the firing voltage and the resistor warming temperature further comprises:

applying the firing voltage in a range of about 25-29 V; and applying the resistor warming temperature in a range of about 45-55° C.

11. The method of claim 1, further comprising:

using the latex ink or the dispersed polymer particle ink with a particle size below 150 nm and a glass transition temperature (Tg) below 80° C.

12. A thermal ink jet (TIJ) printing apparatus comprising:

a TIJ printhead comprising:

a firing chamber to jet a latex ink or a dispersed polymer particle ink from a nozzle; and a resistor to heat the latex ink or the dispersed polymer particle ink to jet from the nozzle;

a memory storing machine readable instructions to:

apply F electrical firing pulses to the resistor of the TIJ printhead for a duration of about 0.50 to 1.00 μs to jet the latex ink or the dispersed polymer particle ink from the nozzle, wherein an F electrical firing pulse represents a main electrical firing pulse; and a processor to implement the machine readable instructions.

13. The TIJ printing apparatus of claim 12, further comprising:

a thin film stack for the TIJ printhead including:

a Tantalum (Ta) cavitation resistance layer formed in a range of about 0-5100 Å, and passivation Silicon Nitride (SiN) and Silicon Carbide (SiC) layers formed in a range of about 900-2500 Å.

14. The TIJ printing apparatus of claim 12, wherein the firing chamber includes:

a SU8 bore layer formed in a range of about 5-40 μm, and a SU8 chamber layer formed in a range of about 9-40 μm.

15. A thermal ink jet (TIJ) printhead comprising:

a firing chamber to jet a latex ink or a dispersed polymer particle ink from a nozzle, wherein the firing chamber includes:

a SU8 bore layer formed in a range of about 5-40 μm, and a SU8 chamber layer formed in a range of about 9-40 μm; and a thin film stack for the TIJ printhead including:

a Tantalum (Ta) cavitation resistance layer formed in a range of about 0-5100 Å, and passivation Silicon Nitride (SiN) and Silicon Carbide (SiC) layers formed in a range of about 900-2500 Å.

* * * * *